United States Patent [19]

Anderson

[11] 4,366,908

[45] Jan. 4, 1983

[54] ARTICLE SUPPORT

[76] Inventor: H. Victor Anderson, P.O. Box 327, Frazee, Minn. 56544

[21] Appl. No.: 182,990

[22] Filed: Sep. 2, 1980

[51] Int. Cl.[3] ..... A47F 5/08

[52] U.S. Cl. ..... 211/87; 248/224.3

[58] Field of Search ..... 211/87, 123, 100, 94, 211/1.3; 248/224.3, 225.1

[56] References Cited

U.S. PATENT DOCUMENTS

| | | | |
|---|---|---|---|
| 2,430,571 | 11/1947 | Johnson | 211/100 |
| 2,530,892 | 11/1950 | Mayo | 248/224.3 X |
| 3,174,628 | 3/1965 | Kirch | 248/224.3 X |
| 4,094,415 | 6/1978 | Larson | 211/87 X |
| 4,159,773 | 7/1979 | Losenno | 248/224.3 X |

FOREIGN PATENT DOCUMENTS

| | | | |
|---|---|---|---|
| 995692 | 6/1965 | United Kingdom | 248/224.3 |

*Primary Examiner*—William E. Lyddane

*Assistant Examiner*—Robert W. Gibson, Jr.

*Attorney, Agent, or Firm*—Kinney, Lange, Braddock, Westman and Fairbairn

[57] ABSTRACT

The present invention relates to a support for articles mounted on a generally upright surface. The invention comprises a bracket, an insert body member which has two insert elements, and an elongated article support or rack attached to the insert body. The bracket is mounted on the upright surface and acts in cooperation with the surface to form an aperture. The two insert elements of the insert body member are generally perpendicular and each insert element is positionable in the aperture. When the body member is positioned for use with one insert element in the bracket, the article support extends generally perpendicular to the surface, and when positioned for storage with the other insert element in the bracket, the article support or rack is positioned generally parallel to the upright surface.

4 Claims, 4 Drawing Figures

ARTICLE SUPPORT

BACKGROUND OF THE INVENTION

1. Field of the Invention

The present invention relates to article supports or racks, and specifically to a rack which can be supported for use and stored on the same support.

2. Prior Art

Many upright surface mounted devices for the supporting of articles are known in the prior art. These devices, such as towel racks, clothing hooks, shelves and the like, are generally attached to a wall or upright member, and once attached are fixed in position. The fixed arms extend out from the mounting surface and these devices are not suitable for mounting in areas of heavy traffice such as a hallway, or in areas where space is of the essence such as a motorhome, trailer, boat or rest room.

The present device overcomes this problem. When positioned for use, the rack disclosed functions as a fixed article supporting device or rack. The present device also has the unique ability to be positioned for storage at its location on an upright surface so that it does not extend from the surface and thus saves space. In addition, the device is completely self-contained and can be quickly and easily switched from its storage position to its functional position.

SUMMARY OF THE INVENTION

The present invention is an article supporting device or rack suitable for mounting on a generally upright surface and can be stored at its location of use. An elongated article support means mounted on an insert body member is positioned relative to the upright surface by placing the body member on a bracket mounted on the surface. As shown, the bracket cooperates with the upright surface to form an aperture and the insert body member has two separate insert elements which are positionable in the aperture. One of the insert elements of the body member is generally perpendicular to the article support means (as shown a plurality of towel rods) so that when that insert element is positioned in the aperture, the rods extend generally perpendicular to the upright surface in a position to support articles. The other insert element is generally parallel to the article support means so that when it is positioned in the aperture, the rods are fixed in generally parallel to the upright surface for storage.

The device is thus both functional and spatially efficient at one location. The traditional problems of such towel bars and the like when they are located in areas such as motor homes, boats or bathrooms are thus overcome because the support can be stored readily out of the way and just as readily be positioned for use when needed. The device of the invention is also of simple design and manufacture.

DETAILED DESCRIPTION OF THE PREFERRED EMBODIMENT

Figure 1:
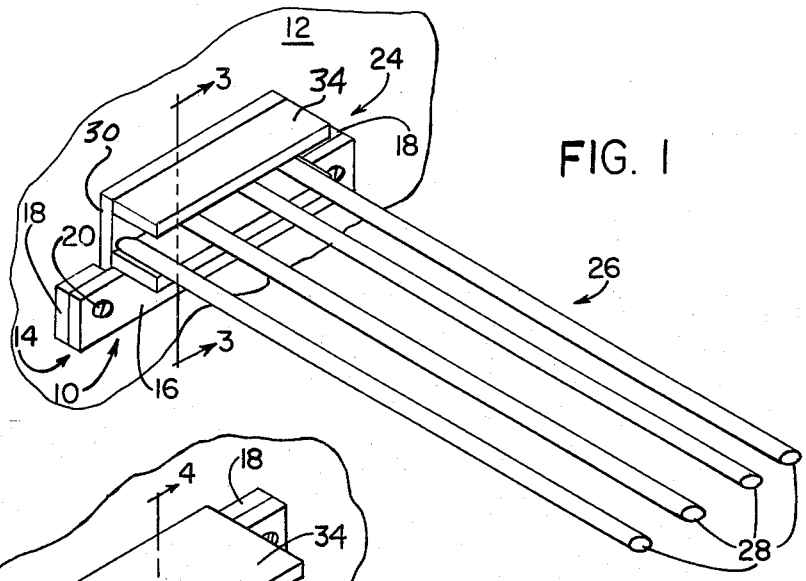
FIG. 1 is a perspective view of the article supporting device or rack of the present invention in its usable position.
Figure 2:
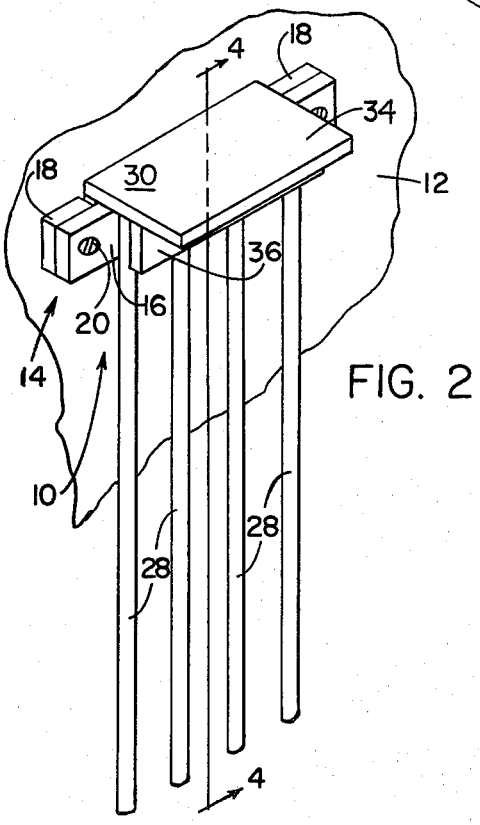
FIG. 2 is a perspective view of the supporting device in its storage position.

FIG. 1 shows an article supporting device 10, mounted in its usable position on a generally upright surface 12. FIG. 2 shows the article supporting device mounted on the surface in its storage position. FIGS. 1 and 2 also illustrate the general configuration of the article supporting device 10. As shown the article supports comprise a plurality of elongated rods.

A bracket 14 is comprised of a generally planer bar portion 16 with a longitudinal axis and a pair of spacers 18,18 at the ends of the bar portion and spaced along the length of the bar portion. The bracket is attached to the generally upright surface by suitable means, such as screws 20 as shown in FIG. 1, which pass through the spacers 18 to form an aperture 22 in cooperation with the surface 12. Of course, other means of forming the aperture in the bracket on the surface are also acceptable.

An insert body member 24 has an elongated article support means 26 mounted thereon. As shown, the elongated article support means comprise a plurality of support rods 28 from which towels or clothing may be supported. A shelf or other constructions also may be used.

Figure 3:
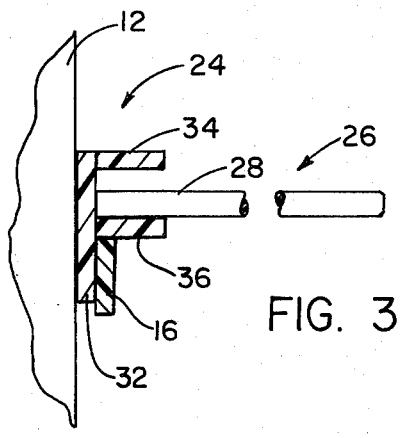
FIG. 3 is a sectional view along section 3—3 of FIG. 1.
Figure 4:
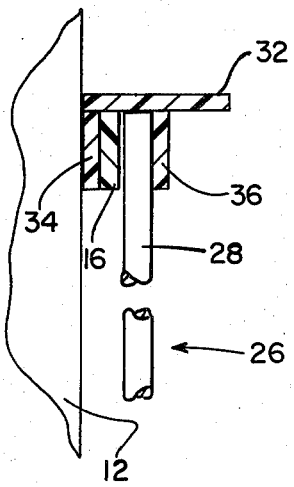
FIG. 4 is a sectional view along FIG. 4—4 of FIG. 2.

As shown in FIGS. 3 and 4, the insert body member 24 is comprised of a plate 30, one end portion of which forms an insert element 32, and a panel 34 attached at the opposite ends of the plate and at right angles thereto, which also acts as an insert element.

In addition, the insert body member, as shown in FIGS. 3 and 4, includes a support panel 36 attached to the plate 30 and which helps support the rods 28. Plate 30, and panels 34 and 36 are positioned generally perpendicular to each other, thus providing the unique design which allows support rods to be held in both usable and storage positions on the same bracket.

As shown in FIG. 3, the article supporting device comprising rods 28 are positioned for use. Plate 30 fits into aperture 22 and is held by bar 16 so that the rods 28 are positioned generally perpendicular to the surface 12. The rods are also fixed to make them easy to use. Panel 36 provides support for the rods 28 and aligns them in a generally horizontal plane.

FIG. 4 shows the positioning of the insert body member 24 for storage or non-use. Support panel 34, which is mounted on plate 30 generally parallel to and spaced from the rods 28, is placed in aperture 22 and held there by bar 16. The article support means 26, comprising rods 28, is generally parallel to surface 12, as shown in FIGS. 2 and 4. Positioning the article support device in this storage position conserves space so the rods do not extend from the upright surface 12 and they are thus out of the way.

The article support device of the present invention provides a simple means by which to increase spatial efficiency of such devices. The same support bracket permits positioning the unit for use and storage. When not needed, rods may be close to the wall and thus not extending outwardly from the wall or surface.

Although the present invention has been described with reference to the preferred embodiment, workers skilled in the art will recognize that changes may be made in form and detail without departing from the spirit and scope of the invention.

What is claimed is:

1. A device for supporting articles comprising in combination:

means forming an aperture including a bracket suitable for mounting on a generally upright surface;

an insert body member comprising plate means having first and second end portions and a third center portion, the first portion forming a first insert element removably positionable in the aperture;

an elongated article support means mounted on the third center portion of the plate means generally perpendicular to the plate means, whereby the elongated article support means is positioned for use generally perpendicular to a generally upright surface on which the bracket is mounted when the first portion of the plate means is positioned in the aperture, panel means mounted on the second portion of the plate means generally perpendicular to the plate means and spaced from and generally parallel to the elongated article support means, said panel forming a second insert element and being selectively positionable in said aperture, whereby the elongated article support means is positioned for storage generally parallel to a generally upright surface on which the bracket is mounted when the second insert element is positioned in the aperture.

2. The device of claim 1 wherein the bracket comprises a generally planar portion having a longitudinal axis generally parallel to the surface on which the bracket is mounted, and separate means spaced along the longitudinal axis of the planar portion adapted to be secured to a surface to form the aperature in combination with the surface.

3. The device of claim 2 wherein the aperture is generally rectangular when viewed in direction along an upright line generally parallel to a surface on which the bracket is mounted.

4. The device of claim 1 wherein the elongated article support means comprises a plurality of support rods.

* * * * *